US011431124B2

(12) United States Patent
Oomori et al.

(10) Patent No.: US 11,431,124 B2
(45) Date of Patent: Aug. 30, 2022

(54) RUBBER PLUG

(71) Applicants: SUMITOMO WIRING SYSTEMS, LTD., Mie (JP); HONDA MOTOR CO., LTD., Tokyo (JP)

(72) Inventors: Ryo Oomori, Mie (JP); Yukihiro Fukatsu, Mie (JP); Daichi Ikeda, Saitama (JP); Naoki Kobayashi, Saitama (JP)

(73) Assignees: SUMITOMO WIRING SYSTEMS, LTD., Mie (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/222,159

(22) Filed: Apr. 5, 2021

(65) Prior Publication Data

US 2021/0313736 A1 Oct. 7, 2021

(30) Foreign Application Priority Data

Apr. 6, 2020 (JP) ..... JP2020-068164

(51) Int. Cl.
*H01R 13/52* (2006.01)
*H01R 13/58* (2006.01)
*H01R 13/56* (2006.01)

(52) U.S. Cl.
CPC ..... *H01R 13/5205* (2013.01); *H01R 13/58* (2013.01); *H01R 13/562* (2013.01)

(58) Field of Classification Search
CPC ... H01R 13/5205; H01R 13/58; H01R 13/562
See application file for complete search history.

(56) References Cited

U.S. PATENT DOCUMENTS 5,562,494 A * 10/1996 Fujiwara ..... H01R 13/5205 439/275
5,660,566 A * 8/1997 Ohsumi ..... H01R 13/5205 439/275
7,147,500 B2 * 12/2006 Tabata ..... H01R 13/5205 439/274

FOREIGN PATENT DOCUMENTS

JP 2003-272758 9/2003
JP 2012123963 A * 6/2012

* cited by examiner

*Primary Examiner* — Briggitte R. Hammond
(74) *Attorney, Agent, or Firm* — Greenblum & Bernstein, P.L.C.

(57) ABSTRACT

A rubber plug has a tubular sealing function portion that allows an electric wire to pass through the tubular sealing function portion and a tubular low-rigidity portion that allows the electric wire to pass through the low-rigidity portion. The sealing function portion exhibits sealing performance by elastically coming into close contact with the inner peripheral surface of the terminal accommodating chamber and the outer peripheral surface of the electric wire. The low-rigidity portion has a lower rigidity than the sealing function portion, and is arranged rearward of the sealing function portion.

8 Claims, 6 Drawing Sheets

RUBBER PLUG

TECHNICAL FIELD

The present disclosure relates to a rubber plug.

BACKGROUND ART

Patent Literature 1 discloses a rubber plug that is inserted into a housing while an electric wire is passed through the rubber plug. The front end portion of the rubber plug is crimped to a terminal fitting together with the electric wire. The portion of the electric wire led out to the rear of the rubber plug is routed outside the housing.

CITATIONS LIST

Patent Literature

Patent Literature 1: Japanese Unexamined Patent Publication No. 2003-272758

SUMMARY OF INVENTION

Technical Problems

When the rubber plug is attached to a vehicle connector, the electric wire swings like shaking its head with the rear end of the rubber plug as a fulcrum due to the vibration during traveling. At this time, the electric wire bends with a small radius of curvature at the rear end of the rubber plug. Thus, if the electric wire repeatedly swings, the electric wire may break at the rear end of the rubber plug.

The rubber plug of the present disclosure has been completed based on the above circumstances, and an object of the present disclosure is to prevent breakage of an electric wire.

Solutions to Problems

The rubber plug of the present disclosure has a tubular sealing function portion that allows an electric wire to pass through the sealing function portion, and a tubular low-rigidity portion that allows the electric wire to pass through the low-rigidity portion, in which the sealing function portion exhibits sealing performance by elastically coming into close contact with an inner peripheral surface of a terminal accommodating chamber and an outer peripheral surface of the electric wire, and the low-rigidity portion has a lower rigidity than the sealing function portion, and is arranged rearward of the sealing function portion.

Advantageous Effects of Invention

According to the present disclosure, it is possible to prevent breakage of an electric wire.

DESCRIPTION OF EMBODIMENTS

Description of the Embodiments of the Present Disclosure

First, the embodiments of the present disclosure will be listed and described.

(1) The rubber plug of the present disclosure includes a tubular sealing function portion that allows an electric wire to pass through the sealing function portion, and a tubular low-rigidity portion that allows the electric wire to pass through the low-rigidity portion, in which the sealing function portion exhibits sealing performance by elastically coming into close contact with an inner peripheral surface of a terminal accommodating chamber and an outer peripheral surface of the electric wire, and the low-rigidity portion has a lower rigidity than the sealing function portion, and is arranged rearward of the sealing function portion. According to this configuration, when the electric wire swings behind the rubber plug, the low-rigidity portion elastically swings by following the electric wire, so that the vibration energy of the electric wire is attenuated. As a result, the swing amplitude of the electric wire in the rubber plug is reduced, so that the electric wire can be prevented from breaking.

(2) The low-rigidity portion preferably has a recess formed on an outer peripheral surface of the low-rigidity portion. According to this configuration, the inner peripheral surface of the low-rigidity portion can be brought into close contact with the outer peripheral surface of the electric wire, so that the vibration energy of the electric wire can be effectively attenuated.

(3) An inner diameter of the low-rigidity portion is preferably equal to or less than an outer diameter of the electric wire. According to this configuration, the inner peripheral surface of the low-rigidity portion can be brought into close contact with the outer peripheral surface of the electric wire, so that the vibration energy of the electric wire can be effectively attenuated.

Details of the Embodiments of the Present Disclosure

Example 1

Figure 1:
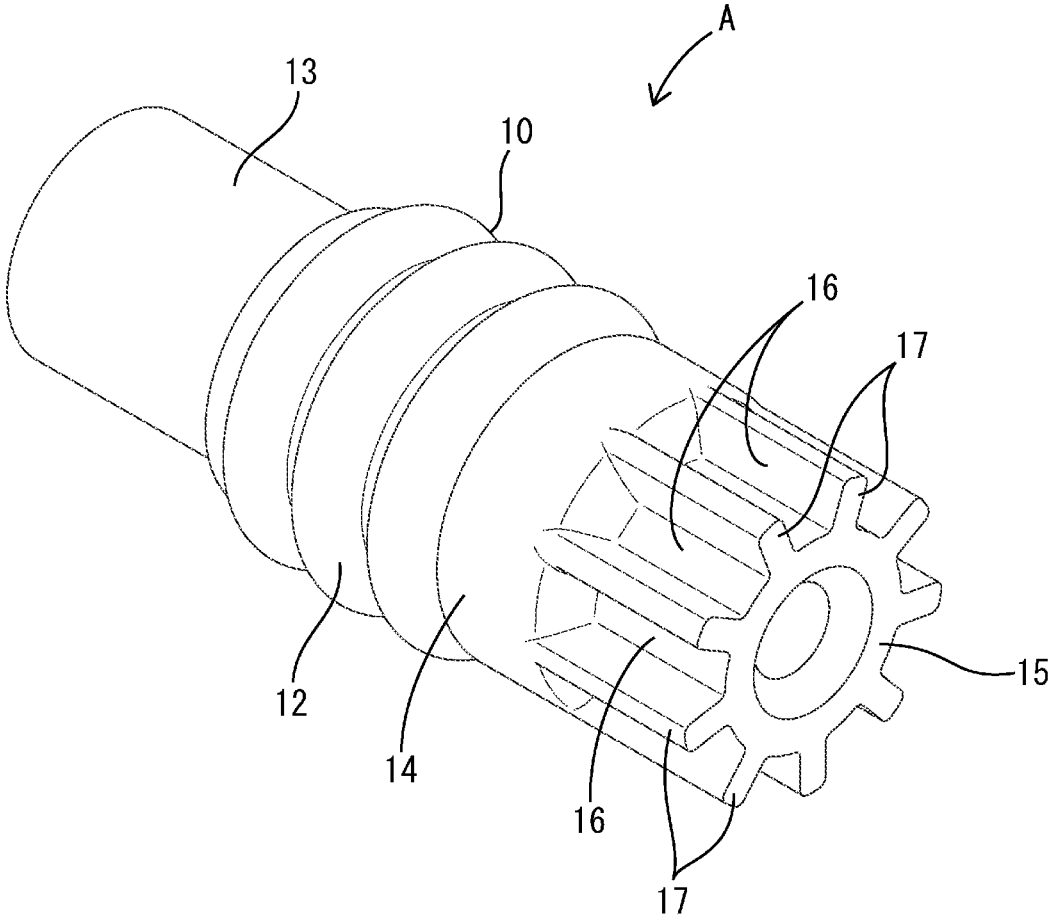
FIG. 1 is a perspective view of a rubber plug of Example 1.
Figure 2:
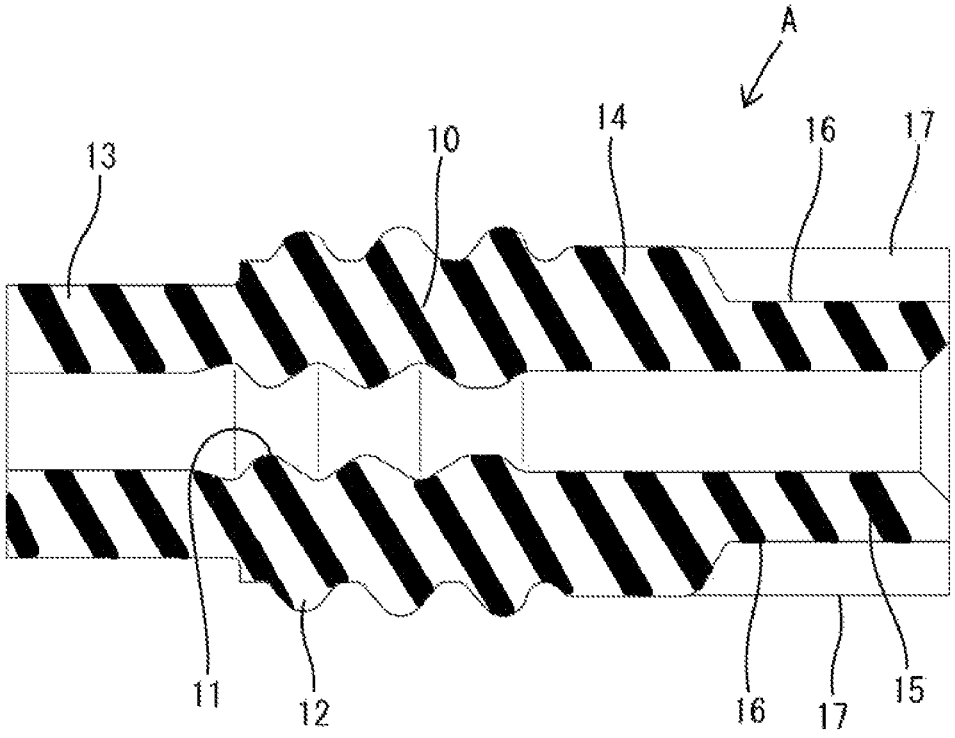
FIG. 2 is a side cross-sectional view of the rubber plug.
Figure 3:
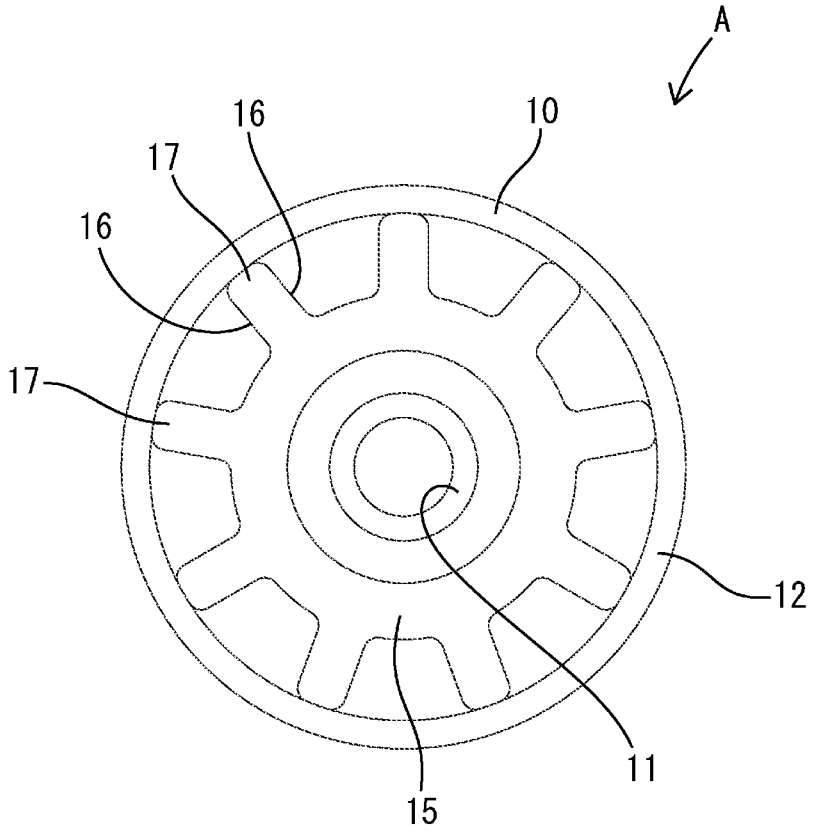
FIG. 3 is a rear view of the rubber plug.
Figure 4:
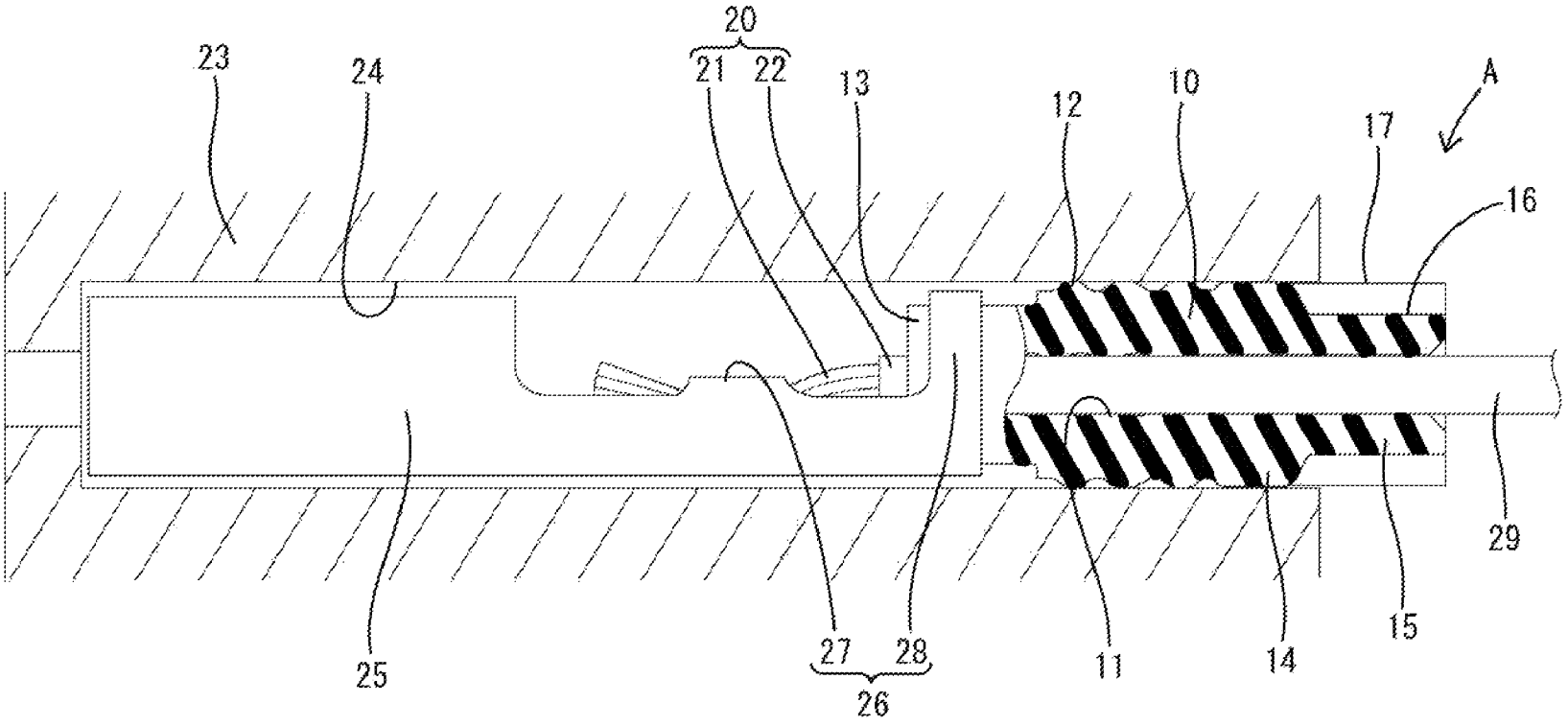
FIG. 4 is a side cross-sectional view of the rubber plug fixed to a terminal fitting in a terminal accommodating chamber.

Example 1 embodying a rubber plug A of the present disclosure will be described with reference to FIGS. 1 to 4. It should be noted that the present invention is not limited to these examples, and is indicated by the scope of claims, and is intended to include all modifications within the meaning and scope equivalent to the scope of claims. In this Example 1, as for the front-rear direction, the left in FIGS. 2 and 4 is defined as the front. The front-rear direction and the axial direction are used interchangeably.

The rubber plug A of this Example surrounds the front end portion of an electric wire 20 in which a conductor 21 is surrounded by an insulating coating 22. The rubber plug A is fixed to a terminal fitting 25 together with the electric wire 20, and is accommodated in a terminal accommodating chamber 24 of a housing 23. The rubber plug A exhibits a waterproof function of sealing between the outer peripheral surface of the electric wire 20 and the inner peripheral surface of the terminal accommodating chamber 24 in a liquid-tight manner. The housing 23 constitutes a connector (not shown) of a wire harness mounted in a vehicle.

The terminal fitting 25 has an elongated shape in the front-rear direction as a whole. An open barrel-shaped crimping portion 26 for crimping to the front end portion of the electric wire 20 is formed at the rear end portion of the terminal fitting 25. The crimping portion 26 is constructed of a wire barrel portion 27 and an insulation barrel portion 28 that is continued to the rear end of the wire barrel portion 27. The wire barrel portion 27 is fixed to the conductor 21 exposed by removing the insulating coating 22 at the front end portion of the electric wire 20. The insulation barrel portion 28 is fixed to a terminal fixing portion 13 at the front end portion of the rubber plug A having been externally fitted to the electric wire 20.

The rubber plug A is a single component having a cylindrical shape as a whole. As shown in FIGS. 1 and 2, the rubber plug A has a sealing function portion 10, the terminal fixing portion 13, an extension portion 14, and a low-rigidity portion 15. On the inner peripheral surface of the sealing function portion 10, a plurality of inner peripheral lips 11 extending in the circumferential direction is formed at a constant pitch in the front-rear direction. On the outer peripheral surface of the sealing function portion 10, a plurality of outer peripheral lips 12 extending in the circumferential direction is formed at a constant pitch in the front-rear direction. The inner peripheral lips 11 are in close contact with the outer peripheral surface of the insulating coating 22 of the electric wire 20 in a liquid-tight manner. The outer peripheral lips 12 are in close contact with the inner peripheral surface of the terminal accommodating chamber 24 in a liquid-tight manner.

The terminal fixing portion 13 has a form coaxially extending forward from the front end of the sealing function portion 10. The dimensions of the terminal fixing portion 13 in the state where the electric wire 20 is not passing through the rubber plug A are as follows. Both the inner and outer diameters of the terminal fixing portion 13 are constant over the entire length from the front end to the rear end of the terminal fixing portion 13. The inner diameter of the terminal fixing portion 13 is larger than the minimum inner diameter of the sealing function portion 10. The outer diameter of the terminal fixing portion 13 is smaller than the maximum outer diameter of the sealing function portion 10.

The extension portion 14 has a form coaxially extending rearward from the rear end of the sealing function portion 10. The dimensions of the extension portion 14 in the state where the electric wire 20 is not passing through the rubber plug A are as follows. The front-rear dimension of the extension portion 14 is smaller than the front-rear dimensions of the sealing function portion 10 and the terminal fixing portion 13. Both the inner and outer diameters of the extension portion 14 are constant over the entire length from the front end to the rear end of the extension portion 14. The inner diameter of the extension portion 14 is larger than the minimum inner diameter of the sealing function portion 10. The inner diameter of the extension portion 14 is equal to or less than the outer diameter of the electric wire 20, that is, the same as or smaller than the outer diameter of the electric wire 20. The outer diameter of the extension portion 14 is smaller than the maximum outer diameter of the sealing function portion 10. The outer diameter of the extension portion 14 is equal to or larger than the inner diameter of the terminal accommodating chamber 24, that is, the same as or slightly larger than the inner diameter of the terminal accommodating chamber 24. The wall thickness of the extension portion 14 in the radial direction is smaller than the maximum wall thickness of the sealing function portion 10 in the radial direction.

The low-rigidity portion 15 has a form coaxially extending rearward from the rear end of the extension portion 14. A plurality of recesses 16 is formed in the outer periphery of the low-rigidity portion 15 at regular pitches in the circumferential direction. The recesses 16 are formed over the entire length from the front end to the rear end of the low-rigidity portion 15. The recesses 16 are open to the rear end surface of the low-rigidity portion 15, that is, the rear end surface of the rubber plug A. Portions between the recesses 16 adjacent to each other in the circumferential direction are ribs 17 that separate the recesses 16. Each rib 17 has a form that projects outward in the radial direction and extends in the front-rear direction. The portions of the low-rigidity portion 15 where the recesses 16 are formed have a smaller wall thickness in the radial direction than the portions of the low-rigidity portion 15 where the ribs 17 are formed.

The dimensions of the low-rigidity portion 15 in the state where the electric wire 20 is not passing through the rubber plug A are as follows. The inner diameter of the low-rigidity portion 15 is constant over the entire length from the front end to the rear end of the low-rigidity portion 15, and is the same dimension as the inner diameter of the extension portion 14. Therefore, there is no step between the inner peripheral surface of the extension portion 14 and the inner peripheral surface of the low-rigidity portion 15. The portions of the low-rigidity portion 15 where the recesses 16 are formed have a smaller outer diameter than the extension portion 14. The portions of the low-rigidity portion 15 where the recesses 16 are not formed, that is, the portions where the ribs 17 are formed, have the same outer diameter as the extension portion 14. Therefore, the rigidity of the low-rigidity portion 15, in a state where an external force that bends the axis of the rubber plug A is applied, is smaller than that of the extension portion 14.

When the rubber plug A fixed to the terminal fitting 25 and the electric wire 20 is inserted in the terminal accommodating chamber 24, the entire terminal fixing portion 13, the entire sealing function portion 10, and the entire extension portion 14 are accommodated in the terminal accommodating chamber 24. The sealing function portion 10 is elastically deformed so as to be crushed in the radial direction, so that the inner peripheral lips 11 elastically come into close contact with the outer peripheral surface of the electric wire 20, and the outer peripheral lips 12 elastically come into close contact with the inner peripheral surface of the terminal accommodating chamber 24. Due to this close contact form, a gap between the outer periphery of the electric wire 20 and the inner periphery of the terminal accommodating chamber 24 is sealed in a liquid-tight manner. The inner peripheral surface of the extension portion 14 contacts the outer peripheral surface of the electric wire 20, and the outer peripheral surface of the extension portion 14 contacts the inner peripheral surface of the terminal accommodating chamber 24.

The entire low-rigidity portion 15 projects to the outside of the terminal accommodating chamber 24, that is, to the rear outside of the housing 23. A region of the electric wire 20 rearward from the rubber plug A is also led out to the rear outside of the housing 23. A lead-out region 29 of the electric wire 20 routed outside the housing 23 swings like shaking its head due to the vibration of the vehicle while traveling and the vibration of the engine. At this time, the lead-out region 29 of the electric wire 20 swings with the rear end of the rubber plug A as a fulcrum. If the electric wire 20 bends with a small radius of curvature at the fulcrum of the swing, the conductor 21 of the electric wire 20 may break due to repeated swinging.

As a countermeasure against the above, the low-rigidity portion 15 is formed at the rear end of the rubber plug A. Since the low-rigidity portion 15 has a lower rigidity than the extension portion 14, when the electric wire 20 swings, the low-rigidity portion 15 elastically swings by following the electric wire 20. Since the vibration energy of the electric wire 20 is attenuated by the elastic deformation of the low-rigidity portion 15, the swing amplitude of the electric wire 20 in the low-rigidity portion 15 and the extension portion 14 is reduced.

Further, when the low-rigidity portion 15 elastically deforms in a flexible manner, the electric wire 20 may bend with a small radius of curvature at the rear end of the extension portion 14 to which the front end of the low-rigidity portion 15 is continued, and the electric wire 20 may break at this bent portion. As a countermeasure against it, the wall thickness of the extension portion 14 in the radial direction is made smaller than the maximum wall thickness of the sealing function portion 10. As a result, the amount of the extension portion 14 crushed in the radial direction between the electric wire 20 and the terminal accommodating chamber 24, that is, the amount of elastic deformation of the extension portion 14 in the radial direction becomes smaller than that of the sealing function portion 10. Accordingly, the stress generated in the inner peripheral portion of the extension portion 14 is smaller than that in the sealing function portion 10. That is, when the electric wire 20 swings, the inner peripheral rear end portion of the extension portion 14 is relatively easily elastically deformed. Therefore, the electric wire 20 is less likely to bend with a small radius of curvature at the rear end of the extension portion 14, so that the electric wire 20 is prevented from breaking.

The rubber plug A of this Example 1 has the tubular sealing function portion 10 that allows the electric wire 20 to pass through the sealing function portion 10, and the tubular low-rigidity portion 15 that allows the electric wire 20 to pass through the low-rigidity portion 15. The sealing function portion 10 exhibits sealing performance by elastically coming into close contact with the inner peripheral surface of the terminal accommodating chamber 24 and the outer peripheral surface of the electric wire 20. The low-rigidity portion 15 has a lower rigidity than the sealing function portion 10, and is arranged rearward of the sealing function portion 10. When the electric wire 20 swings behind the rubber plug A, the low-rigidity portion 15 elastically swings by following the electric wire 20, so that the vibration energy of the electric wire 20 is attenuated. As a result, the swing amplitude of the electric wire 20 in the rubber plug A is reduced, so that the electric wire 20 can be prevented from breaking.

Since the inner diameter of the low-rigidity portion 15 is equal to or less than the outer diameter of the electric wire 20, that is, the same as or smaller than the outer diameter of the electric wire 20, the inner peripheral surface of the low-rigidity portion 15 can be brought into close contact with the outer peripheral surface of the electric wire 20. As a result, the vibration energy of the electric wire 20 can be effectively attenuated. Since the inner diameter of the low-rigidity portion 15 is the same as the inner diameter of the extension portion 14, there is no step at the portion where the inner peripheral rear end of the extension portion 14 and the inner peripheral front end of the low-rigidity portion 15 are continued. As a result, the concentration of stress on the electric wire 20 can be reduced.

Since the low-rigidity portion 15 has recesses 16 formed on the outer peripheral surface of the low-rigidity portion 15, the rigidity of the low-rigidity portion 15 can be reduced even if the inner peripheral surface of the low-rigidity portion 15 is formed into a circular shape in cross section. According to this configuration, the inner peripheral surface of the low-rigidity portion 15 can be brought into close contact with the outer peripheral surface of the electric wire 20, so that the vibration energy of the electric wire 20 can be effectively attenuated.

The rubber plug A has the tubular terminal fixing portion 13 that extends forward from the front end of the sealing function portion 10 and allows the terminal fitting 25 to be fixed. The recesses 16 and ribs 17 are formed on the outer periphery of the low-rigidity portion 15 as identification portions each having a shape different from that of the outer peripheral surface of the terminal fixing portion 13. The front-rear orientation of the rubber plug A can be identified by the recesses 16 and the ribs 17, which can prevent the crimping portion 26 of the terminal fitting 25 from being accidentally fixed to the low-rigidity portion 15.

Example 2

Example 2 embodying a rubber plug B of the present disclosure will be described with reference to FIGS. 5 to 6. In the rubber plug B of this Example 2, a low-rigidity portion 30 has a shape different from that of Example 1 above. The other configurations (sealing function portion 10, inner peripheral lips 11, outer peripheral lips 12, terminal fixing portion 13, and extension portion 14) are the same as those in Example 1 above, so that the same reference numerals are used for the same configurations and the description of the structure, action and effect will be omitted.

The rubber plug B is a single component having a cylindrical shape as a whole. As shown in FIGS. 5 and 6, the rubber plug B has a sealing function portion 10, a terminal fixing portion 13, an extension portion 14, and the low-rigidity portion 30.

The low-rigidity portion 30 has a form coaxially extending rearward from the rear end of the extension portion 14. On the outer periphery of the low-rigidity portion 30, a plurality of recesses 31 (two in this Example 2) spaced apart in the axial direction (front-rear direction) and one notch 33 is formed.

Each recess 31 has a circular shape concentric with the low-rigidity portion 30, and forms a continuous groove shape over the entire circumference of the low-rigidity portion 30. As shown in FIG. 6, in the side cross section obtained by cutting the low-rigidity portion 30 in parallel to the axis of the rubber plug B, the cross-sectional shape of the recess 31 is an isosceles trapezoid. The recess 31 has a pair of front and rear tapered inner surfaces 32 that are oblique to the axis of the rubber plug B. The axial distance between the pair of tapered inner surfaces 32, that is, the axial dimension of the recess 31 is the smallest at the minimum outer diameter of the recess 31 and the largest at the opening of the recess 31 in the outer peripheral surface of the low-rigidity portion 30.

The notch 33 is arranged at the rear end of the low-rigidity portion 30, that is, at a position rearward from the plurality of recesses 31. The notch 33 has a circular shape concentric with the low-rigidity portion 30, and has a form in which the outer peripheral surface portion and rear end surface portion of the low-rigidity portion 30 are continuously cut out over the entire circumference. In the side cross section obtained by cutting the low-rigidity portion 30 in parallel to the axis of the rubber plug B, the notch 33 has a tapered inner surface 34 that is oblique to the axis of the rubber plug B.

Of the outer peripheral surface portion of the low-rigidity portion 30, a portion between the recesses 31 adjacent to each other in the axial direction and a portion between the recess 31 at the rear end and the notch 33 are ribs 35 that separate the recesses 31 or the recess 31 and the notch 33. The rib 35 has a circular shape concentric with the low-rigidity portion 30, and has a form that projects outward in the radial direction from the outer circumference of the low-rigidity portion 30. The rib 35 is continuous over the entire circumference of the low-rigidity portion 30.

The portions of the low-rigidity portion 30 where the recesses 31 are formed and the portion where the notch 33 is formed each have a smaller wall thickness in the radial direction than the portions of the low-rigidity portion 30 where the ribs 35 are formed.

The dimensions of the low-rigidity portion 30 in the state where the electric wire 20 (not shown in FIGS. 5 and 6) is not passing through the rubber plug B are as follows. The inner diameter of the low-rigidity portion 30 is constant over the entire length from the front end to the rear end of the low-rigidity portion 30, and is the same dimension as the inner diameter of the extension portion 14. Therefore, there is no step between the inner peripheral surface of the extension portion 14 and the inner peripheral surface of the low-rigidity portion 30.

The portions of the low-rigidity portion 30 where the recesses 31 are formed have a smaller outer diameter than the extension portion 14. The portions of the low-rigidity portion 30 where the recesses 31 are not formed, that is, the portions where the ribs 35 are formed, have a smaller outer diameter than the extension portion 14. Therefore, the rigidity of the low-rigidity portion 30, in a state where an external force that bends the axis of the rubber plug B is applied, is smaller than the rigidity of the extension portion 14.

Figure 5:
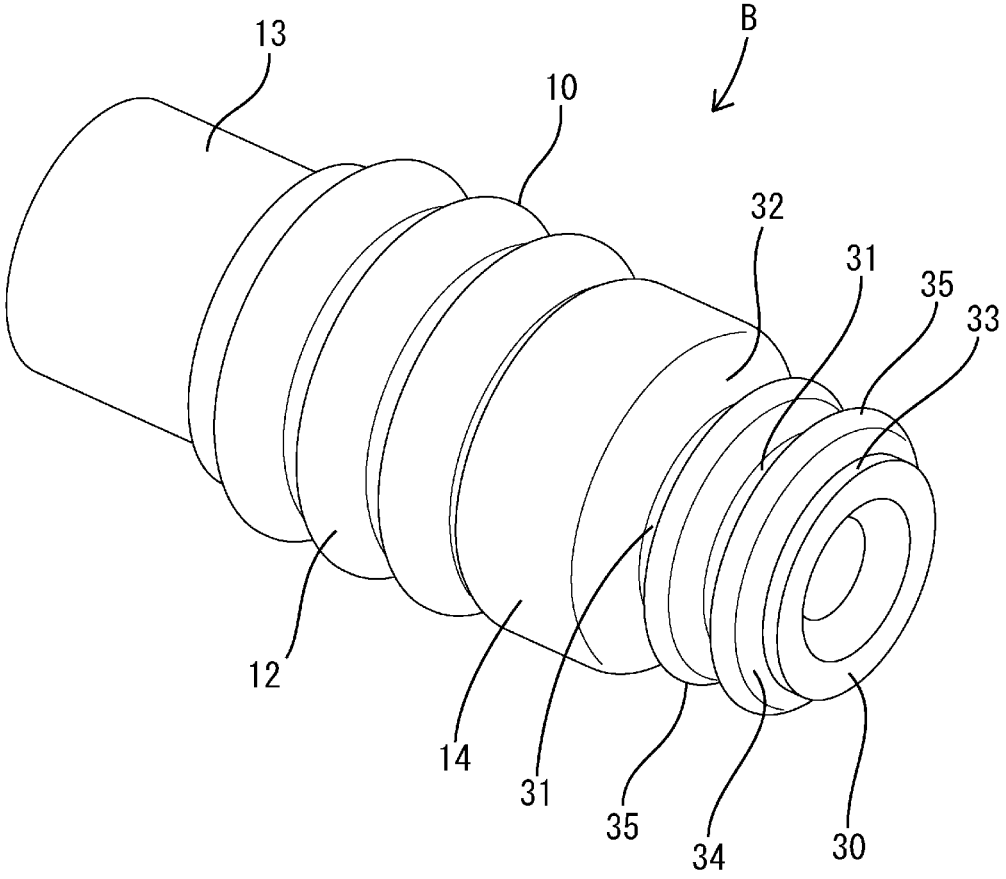
FIG. 5 is a perspective view of a rubber plug of Example 2.
Figure 6:
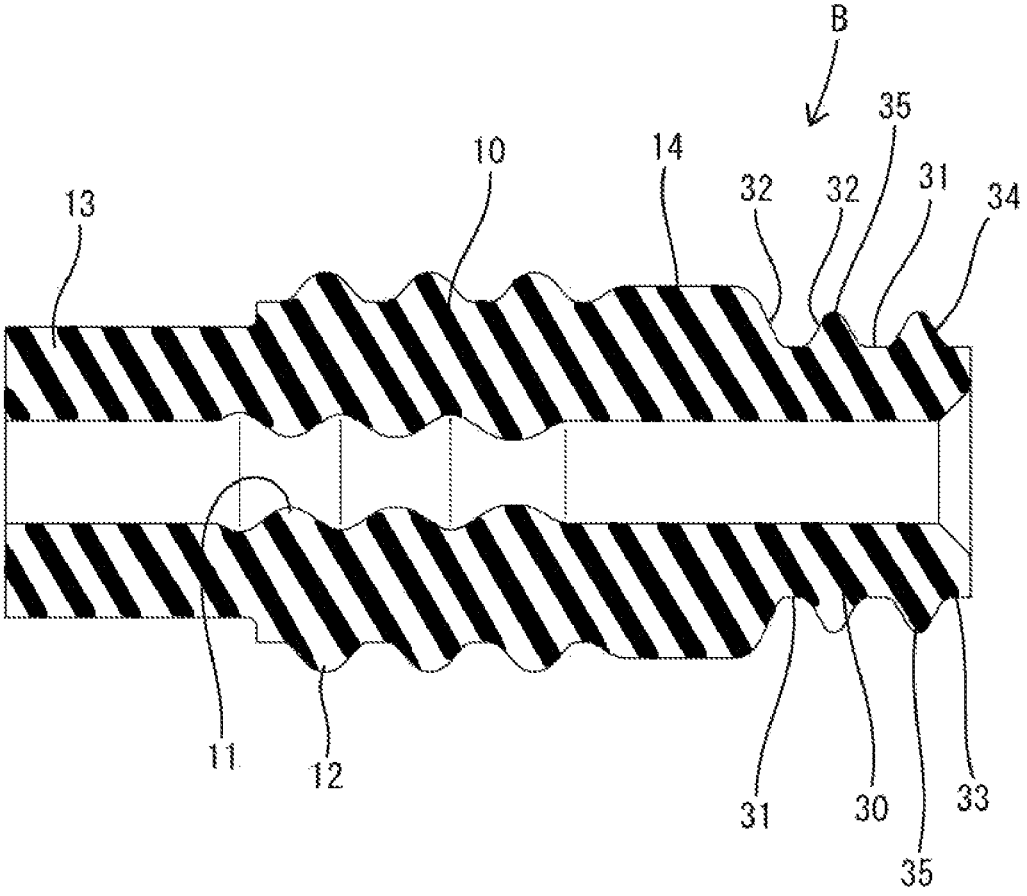
FIG. 6 is a side cross-sectional view of the rubber plug of Example 2.

The entire low-rigidity portion 30 projects to the outside of the terminal accommodating chamber 24 (not shown in FIGS. 5 and 6), that is, to the rear outside of the housing 23 (not shown in FIGS. 5 and 6). A region of the electric wire 20 rearward from the rubber plug B is also led out to the rear outside of the housing 23. A lead-out region 29 of the electric wire 20 routed outside the housing 23 swings like shaking its head due to the vibration of the vehicle while traveling and the vibration of the engine. At this time, the lead-out region 29 of the electric wire 20 swings with the rear end of the rubber plug B as a fulcrum. If the electric wire 20 bends with a small radius of curvature at the fulcrum of the swing, the conductor 21 of the electric wire 20 may break due to repeated swinging.

As a countermeasure against the above, the low-rigidity portion 30 is formed at the rear end of the rubber plug B. Since the low-rigidity portion 30 has a lower rigidity than the extension portion 14, when the electric wire 20 swings, the low-rigidity portion 30 elastically swings by following the electric wire 20. Since the vibration energy of the electric wire 20 is attenuated by the elastic deformation of the low-rigidity portion 30, the swing amplitude of the electric wire 20 in the low-rigidity portion 30 and the extension portion 14 is reduced.

Further, when the low-rigidity portion 30 elastically deforms in a flexible manner, the electric wire 20 may bend with a small radius of curvature at the rear end of the extension portion 14 to which the front end of the low-rigidity portion 30 is continued, and the electric wire 20 may break at this bent portion. As a countermeasure against it, the wall thickness of the extension portion 14 in the radial direction is made smaller than the maximum wall thickness of the sealing function portion 10. As a result, the amount of the extension portion 14 crushed in the radial direction between the electric wire 20 and the terminal accommodating chamber 24, that is, the amount of elastic deformation of the extension portion 14 in the radial direction becomes smaller than that of the sealing function portion 10. Accordingly, the stress generated in the inner peripheral portion of the extension portion 14 is smaller than that in the sealing function portion 10. That is, when the electric wire 20 swings, the inner peripheral rear end portion of the extension portion 14 is relatively easily elastically deformed. Therefore, the electric wire 20 is less likely to bend with a small radius of curvature at the rear end of the extension portion 14, so that the electric wire 20 is prevented from breaking.

The rubber plug B of this Example 2 has the tubular sealing function portion 10 that allows the electric wire 20 to pass through the sealing function portion 10, and the tubular low-rigidity portion 30 that allows the electric wire 20 to pass through the low-rigidity portion 30. The sealing function portion 10 exhibits sealing performance by elastically coming into close contact with the inner peripheral surface of the terminal accommodating chamber 24 and the outer peripheral surface of the electric wire 20. The low-rigidity portion 30 has a lower rigidity than the sealing function portion 10, and is arranged rearward of the sealing function portion 10. When the electric wire 20 swings behind the rubber plug B, the low-rigidity portion 30 elastically swings by following the electric wire 20, so that the vibration energy of the electric wire 20 is attenuated. As a result, the swing amplitude of the electric wire 20 in the rubber plug B is reduced, so that the electric wire 20 can be prevented from breaking.

Since the inner diameter of the low-rigidity portion 30 is equal to or less than the outer diameter of the electric wire 20, that is, the same as or smaller than the outer diameter of the electric wire 20, the inner peripheral surface of the low-rigidity portion 30 can be brought into close contact with the outer peripheral surface of the electric wire 20. As a result, the vibration energy of the electric wire 20 can be effectively attenuated. Since the inner diameter of the low-rigidity portion 30 is the same as the inner diameter of the extension portion 14, there is no step at the portion where the inner peripheral rear end of the extension portion 14 and the inner peripheral front end of the low-rigidity portion 30 are continued. As a result, the concentration of stress on the electric wire 20 can be reduced.

Since the low-rigidity portion 30 has recesses 31 formed on the outer peripheral surface of the low-rigidity portion 30, the rigidity of the low-rigidity portion 30 can be reduced even if the inner peripheral surface of the low-rigidity portion 30 is formed into a circular shape in cross section. According to this configuration, the inner peripheral surface of the low-rigidity portion 30 can be brought into close contact with the outer peripheral surface of the electric wire 20, so that the vibration energy of the electric wire 20 can be effectively attenuated.

The rubber plug B has the tubular terminal fixing portion 13 that extends forward from the front end of the sealing function portion 10 and allows the terminal fitting 25 to be fixed. The recesses 31, notch 33, and ribs 35 are formed on the outer periphery of the low-rigidity portion 30 as identification portions each having a shape different from that of the outer peripheral surface of the terminal fixing portion 13. The front-rear orientation of the rubber plug B can be identified by the recesses 31, notch 33, and ribs 35, which can prevent the crimping portion 26 of the terminal fitting 25 from being accidentally fixed to the low-rigidity portion 30.

Other Examples

The present invention is not limited to Examples 1 and 2 described in the above description and drawings, but is shown by the scope of claims. The present invention includes the meaning equivalent to the scope of claims and all modifications within the scope of claims, and is intended to include the following embodiments.

Although recesses are formed on the outer peripheral surface of the low-rigidity portion in Examples 1 and 2 above, the low-rigidity portion may not have a recess formed on the outer peripheral surface but may have a recess formed on the inner peripheral surface, or may have a smaller wall thickness in the radial direction than the extension portion.

In Examples 1 and 2 above, the inner diameter of the low-rigidity portion is equal to or less than the outer diameter of the electric wire, but the inner diameter of the low-rigidity portion may be larger than the outer diameter of the electric wire.

REFERENCE SIGNS LIST

10 sealing function portion
11 inner peripheral lip
12 outer peripheral lip
13 terminal fixing portion
14 extension portion
15, 30 low-rigidity portion
16, 31 recess (identification portion)
17, 35 rib (identification portion)
20 electric wire
21 conductor
22 insulating coating
23 housing
24 terminal accommodating chamber
25 terminal fitting
26 crimping portion
27 wire barrel portion
28 insulation barrel portion
29 lead-out region
32, 34 tapered inner surface
33 notch (identification portion)
A, B rubber plug

The invention claimed is:

1. A rubber plug comprising:

a tubular seal portion that allows an electric wire to pass through the tubular seal portion; and a tubular low-rigidity portion that allows the electric wire to pass through the tubular low-rigidity portion, wherein the tubular seal portion exhibits sealing performance by elastically coming into close contact with an inner peripheral surface of a terminal accommodating chamber and an outer peripheral surface of the electric wire, the tubular low-rigidity portion has a lower rigidity than the tubular seal portion, and is arranged rearward of the tubular seal portion, the tubular low-rigidity portion has a recess formed on an outer peripheral surface of the tubular low-rigidity portion, and the tubular seal portion includes a plurality of lips on an outer peripheral surface of the tubular seal portion, and a plurality of lips on an inner peripheral surface of the tubular seal portion.

2. The rubber plug according to claim 1, wherein an inner diameter of the tubular low-rigidity portion is equal to or less than an outer diameter of the electric wire.

3. The rubber plug according to claim 1, wherein the tubular seal portion is disposed between the tubular low-rigidity portion and an end of the electric wire that is to be disposed in the terminal accommodating chamber.

4. The rubber plug according to claim 1, further comprising a terminal fixture portion that extends from the tubular seal portion, and the terminal fixture portion includes inner and outer diameters that are constant over an entire length of the terminal fixture portion.

5. The rubber plug according to claim 1, further comprising an extension portion that extends between the tubular seal portion and the tubular low-rigidity portion, and the extension portion includes inner and outer diameters that are constant over an entire length of the extension portion.

6. The rubber plug according to claim 1, wherein the outer peripheral surface of the tubular low-rigidity portion includes a plurality of recesses, and the recesses form a plurality of ribs on the outer peripheral surface of the tubular low-rigidity portion.

7. The rubber plug according to claim 6, wherein the plurality of ribs extend in an axial direction of the rubber plug.

8. The rubber plug according to claim 6, wherein the plurality of ribs extend in a circumferential direction of the rubber plug.

* * * * *